US006511357B1

(12) United States Patent
Williams et al.

(10) Patent No.: US 6,511,357 B1
(45) Date of Patent: Jan. 28, 2003

(54) UTILITY POCKET FOR A LIFE-JACKET

(75) Inventors: Dan Williams, 106 Pirate Cove Dr., Marathon, FL (US) 33050; Dave Kent, Guelph (CA); Helmut Siepmann, Cambridge (CA)

(73) Assignee: Dan Williams, Marathon, FL (US)

( * ) Notice: Subject to any disclaimer, the term of this patent is extended or adjusted under 35 U.S.C. 154(b) by 0 days.

(21) Appl. No.: 10/023,198

(22) Filed: Dec. 17, 2001

(51) Int. Cl.[7] ..... B63C 9/08
(52) U.S. Cl. ..... 441/106; 441/115
(58) Field of Search ..... 441/106, 114, 441/115, 123

(56) References Cited

U.S. PATENT DOCUMENTS

| | | | | |
|---|---|---|---|---|
| 5,326,297 A | | 7/1994 | Loughlin | 441/89 |
| 5,603,646 A | * | 2/1997 | Tobias | 441/106 |
| 5,603,648 A | | 2/1997 | Kea | 441/106 |
| 5,690,413 A | | 11/1997 | Coughlin | 362/108 |
| 5,893,786 A | | 4/1999 | Stevens | 441/89 |
| 6,105,359 A | * | 8/2000 | Wilson | 60/772 |
| 6,354,295 B1 | * | 3/2002 | Hasson, Jr. | 128/201.27 |
| 2001/0016149 A1 | * | 8/2001 | Garofalo | 405/186 |

* cited by examiner

*Primary Examiner*—Stephen Avila
(74) *Attorney, Agent, or Firm*—Baker & Daniels

(57) ABSTRACT

A life jacket comprises a back panel defining a first flotation pocket and adapted to lie adjacent a wearer's back and a front panel defining a second flotation pocket, the front panel being connected with the back panel and adapted to lie adjacent the wearer's front. A pocket member is hingedly attached to and supported from the front panel and is adapted to contain and retain emergency accessories. The pocket member includes a relatively stiff plate member having an inner surface facing toward the front panel when the pocket member is closed and an outer surface facing away from the front panel when the pocket member is closed. The pocket member includes a third flotation pocket that is defined by two layers of a flexible material. Flotation material is located in the first, second and third flotation pockets. At least one fastener for releasably retaining the pocket member in juxtaposition against the front panel, thereby defining at least one pocket between the at least one pocket member and the front panel is provided.

15 Claims, 2 Drawing Sheets

UTILITY POCKET FOR A LIFE-JACKET

This invention relates generally to an improved life-jacket, and has to do particularly with a life-jacket which includes at least one large utility pocket forming part of one or more front panels of the life-jacket, the pocket being adapted to releasably retain emergency accessories, such as flares, for use in an emergency situation.

BACKGROUND OF THIS INVENTION

A number of prior developments in the design of life-jackets are of interest in connection with the present invention.

U.S. Pat. No. 5,893,786, issued Apr. 13, 1999 to Stevens, provides a cylindrical housing in which a pole is adapted to slide, the pole having an outward projecting radial flange at the lower end, the flange being captured within the main housing due to inwardly projecting flanges at the top and bottom end of the housing. At the upper end of the pole there is provided an identification means such as a flag.

U.S. Pat. No. 5,603,648, issued Feb. 18, 1997 to Kea, provides an outdoor survival garment incorporating solid flotation layers, an inflatable bladder, a source of compressed gas carried by the garment, and a variety of electronic items including a battery, photovoltaic solar cells, and at least one electrical heating element. These items, however, are not provided together in a single pouch or space enabling immediate access.

U.S. Pat. No. 5326,297, issued Jul. 5, 1994 to Loughlin, is directed to an amalgamation of various items useful in a situation of danger.

U.S. Pat. No. 5,690,413, issued Nov. 25, 1997 to Coughlin, is directed to the provision of a safety light on a marine or flotation vest.

From the above patents, it is clear that the prior art contemplates the idea of adhering or capturing various emergency accessories within pockets or receiving means forming part of a life jacket. However, these prior designs leave room for improvement, particularly in regard to providing quick access to the accessories, while ensuring that the accessories are securely fastened to the life jacket at all times when not in use.

GENERAL DESCRIPTION OF THIS INVENTION

Accordingly, it is an object of one aspect of this invention to provide a novel design for a life jacket, which incorporates a pocket in which a plurality of emergency accessories (such as flares, etc.) can be securely retained when not in use, but from which they can be quickly retrieved and put into operation. It is an object of another aspect of this invention to provide a utility pocket that is detachable from a life jacket.

According to an aspect of the present invention, there is provided a life jacket comprising:

a back panel defining a first flotation pocket and adapted to lie adjacent a wearer's back;

a front panel defining a second flotation pocket, the front panel being connected with the back panel and adapted to lie adjacent the wearer's front;

at least one pocket member hingedly attached to and supported from the front panel, the at least one pocket member being adapted to contain and retain accessories including:

a relatively stiff plate member having an inner surface facing toward the front panel when the at least one pocket member is closed, and an outer surface facing away from the front panel when the respective pocket member is closed; and a third flotation pocket adjacent the outer surface of the plate member, the flotation pocket being defined by two layers of a flexible material;

flotation material located in the first, second and third flotation pockets; and at least one fastener for releasably retaining the at least one pocket member in juxtaposition against the front panel, thereby defining at least one pocket between the at least one pocket member and the front panel.

According to another aspect of the present invention, there is provided a utility pocket for a life jacket, the utility pocket comprising:

at least one pocket member hingedly attached to and supported from a pocket base member, the pocket base member being coupled to a front panel of the life jacket, the pocket member including:

a relatively stiff plate member having an inner surface facing toward the front panel when the at least one pocket member is closed, and an outer surface facing away from the front panel when the at least one pocket member is closed;

a flotation pocket adjacent the outer surface of the plate member, the flotation pocket being defined by two layers of a flexible material and flotation material being located in the flotation pocket; and wherein the pocket base member is detachable from the front panel of the life jacket

GENERAL DESCRIPTION OF THE DRAWINGS

Embodiments of this invention are illustrated in the accompanying drawings, in which like numerals denote like parts throughout the several views, and in which.

DETAILED DESCRIPTION OF THE DRAWINGS

Figure 1:
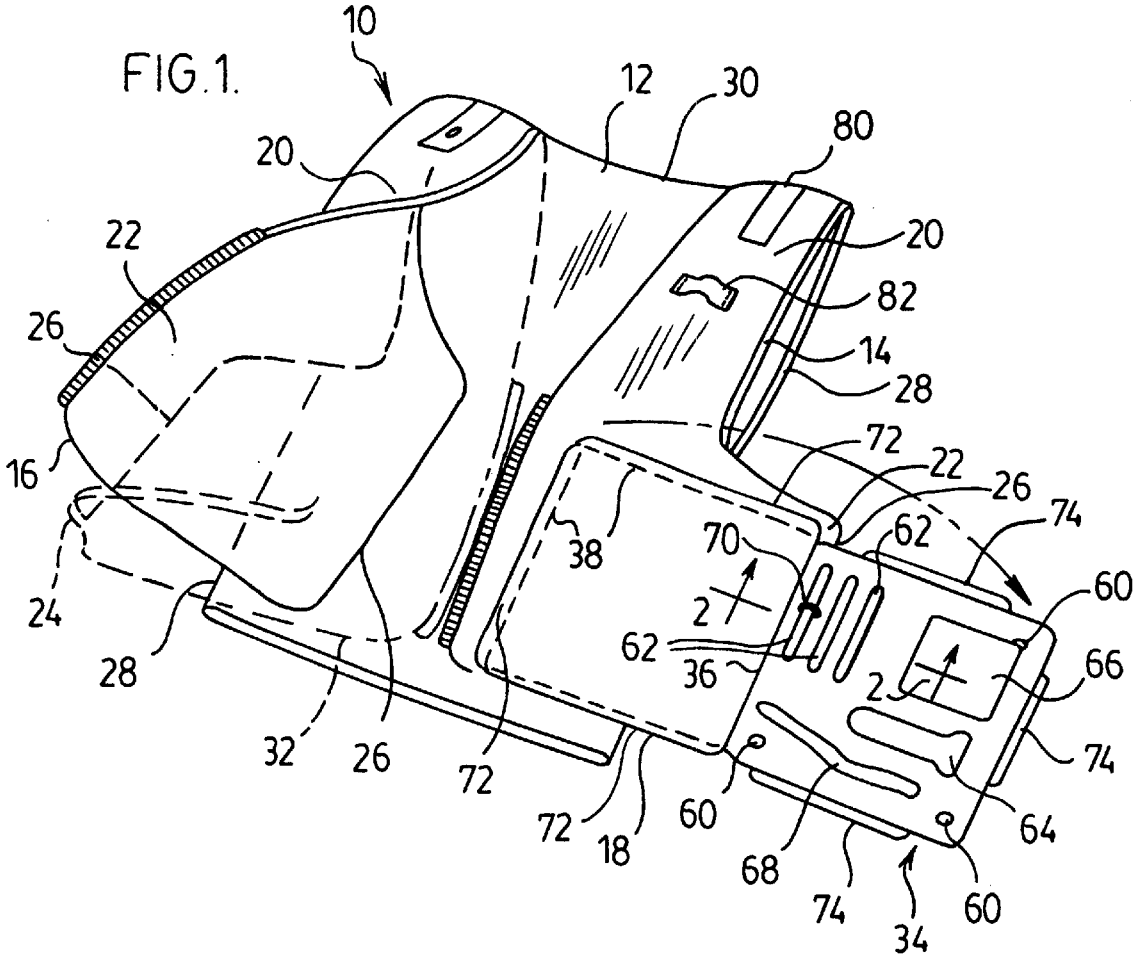
FIG. 1 is a perspective view, taken obliquely from the front, of a life-jacket in accordance with a first embodiment of the present invention.

Attention is first directed to FIG. 1 which illustrates a life-jacket 10 that includes a back panel 12, front panels 14 and 16, and a pocket 18. The pocket 18 includes an openable pocket member 34 that is hingedly attached to and supported from the front panel 14.

The back panel 12 incorporates two substantially rectangular sheets of tough, woven material sewn together along coinciding edges to form a first flotation pocket which is adapted to lie adjacent the wearer's back when the life-jacket is in use.

Each of the front panels 14, 16, incorporates two sheets of tough, woven material with congruent edge configurations. More specifically, each front panel 14, 16 includes an upper, relatively narrow lapel portion 20, and a wider base portion 22.

Strap members 24 (one of which is seen at the left in FIG. 1, in broken lines) loosely tie the outer vertical edge 26 of the base portion 22 to the respective vertical edge 28 of the back panel 12.

As illustrated, the end of each lapel portion 20 is securely sewn to a respective extremity of the top edge 30, whereby each front panel 14, 16 can be lifted away from the back panel 12, by swinging about its connection with the back panel 12. Each front panel 14, 16 is hingedly flexible and can undergo a rolling or twisting movement allowing it to take up a position similar to that of the solid-line depiction of the front panel 16 in FIG. 1. Note that this twisted configuration is merely one of many which are allowed due to the loose connection provided by the strap members 24 and the resilience of the panels. When being worn, however, the front panels 14,16 are aligned approximately parallel with the back panel 12, and take up the positions shown in solid lines for the rightward front panel 14, and in broken lines 32 for the leftward panel 16.

As can be seen in FIG. 1, the rightward front panel 14 hingedly supports the pocket member 34. The hinge connection for the pocket member 34 lies along the vertical edge 36. This hinge position allows the pocket member 34 to swing between a closed position identified by the broken lines 38 in FIG. 1, and an open position identified in solid lines to the right of the broken lines.

Figure 2:
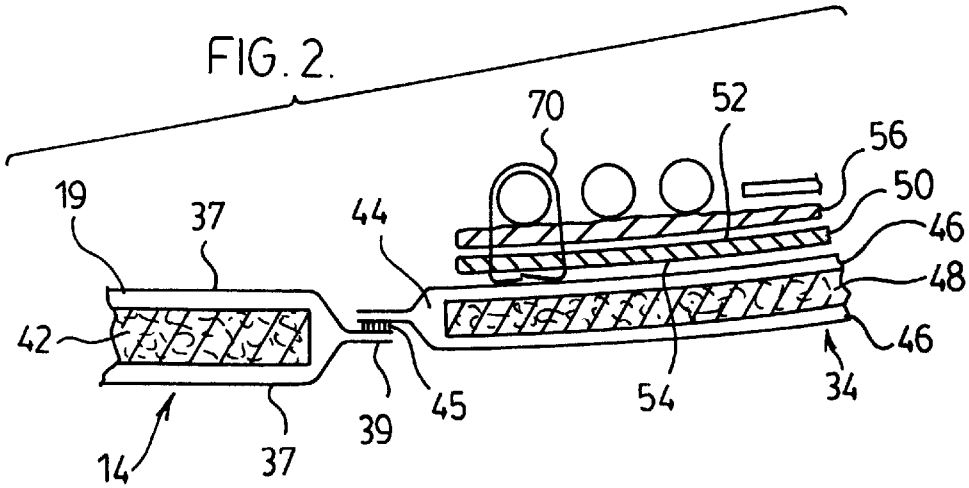
FIG. 2 is a sectional view taken along the line 2—2 in FIG. 1.

Attention is now directed to FIG. 2, which shows a portion of a section through the front panel 14 and the pocket member 34, identified by the line 2—2 in FIG. 1. To the left in FIG. 2, the front panel 14 is seen to include two layers 37 of tough, woven material, sewn together at matching edges 39 to provide an internal flotation pocket 19, the latter containing flotation material 42 which preferably consists of a block of plastic material having internal closed voids.

As further shown in FIG. 2, the pocket member 34 includes a third flotation pocket 44 defined between two layers of tough, woven material 46, enclosing a block of flotation material 48. As indicated at 45, the pocket member 34 is typically sewn to the front panel 14. Alternatively the pocket member 34 may be coupled to the front panel 14 in any suitable manner.

Retained against the layers 46 of material is a relatively stiff plate member 50 which has an inner surface 52 facing toward the front panel 14 when the pocket member 34 is closed, and an outer surface 54 facing away from the front panel 20 when the pocket member 34 is closed. A relatively resilient cushion layer 56 substantially covers the inner surface 52 of the plate member 50.

A plurality of dome fasteners 60 secure the cushion layer 56 and the plate member 50 to the adjacent sheet 46 of the pocket member 34. The fasteners 60 are releasable by the user.

As seen at the right in FIG. 1, the pocket member 34 is adapted to define, with the base portion 22 of the rightward front panel 14, a pocket which receives and retains (until used) such items as flares 62, a flash light 64, a signalling mirror 66, quantity of twine 68, etc.

Preferably, some modality is provided for retaining these items in spaced-apart orientation. In accordance with the present invention, this function is achieved by the provision of the plurality of elasticated loops which extend, at spaced-apart locations, through openings in the plate member 50 and the cushion layer 56. A typical elasticated loop is shown at 70 in FIGS. 1, 2 and 4. Such elasticated loops would extend at least once over each of the items shown in the drawings. Only a single loop is shown in order to avoid cluttering the drawings.

In order to maintain the pocket member 34 in its closed position (broken line 38 in FIG. 1), there are provided Velcro™-like strips 74 on the pocket member 34 and complementary strips 72 on the front panel 14.

There is enough flotation material in the third flotation pocket 44 to counteract the weight of the emergency accessories stored in pocket defined by the pocket member 34. This will tend to cause the wearer of the life-jacket to float with his head back rather than with his head forward, thus allowing him to continue breathing, even if he is unconscious. The block of flotation material 48 thus assumes a particular importance. It can be thickened, if necessary, to counteract any increased weight due to a heavy load of dense materials.

The life jacket 10 of FIG. 1 further includes a pair of reflective strips 80, which allow the life jacket 10 to be spotted in the dark. In addition, a loop 82 is provided on the lapel portion 20. Items such as an emergency whistle, for example, can be stored in the loop 82. The loop 82 would be sized to fit a particular item snugly but not too tight so as to make removal difficult for a wearer. Typically, the item would also be attached to the loop 82 by a cord in order to ensure that the item is not lost in the event that it slips from the loop 82.

The life jacket 10 may also be provided with a parts check list that is printed directly on the front panel 14 adjacent the pocket member 34. The parts check list is useful in the case where a wearer is unfamiliar with the life jacket 10 and there are emergency items missing from the pocket member 34.

It will be appreciated by a person skilled in the art that additional pockets could be provided. The pockets would be arranged to suit the particular application of the life jacket. For example, a second pocket member could be added to the leftward front panel 16, on the life jacket of FIG. 1. The second pocket would generally be a mirror image of the first pocket member 34 and would serve as an additional storage area for other emergency items such as a signalling mirror, a collapsible bailer, an inflatable reflective beacon, light sticks, a pair of manual propelling devices, or a distress flag. Each additional pocket member would include a corresponding flotation pocket that would be filled with sufficient flotation material to counteract the weight of the emergency accessories supported therein.

Figure 3:
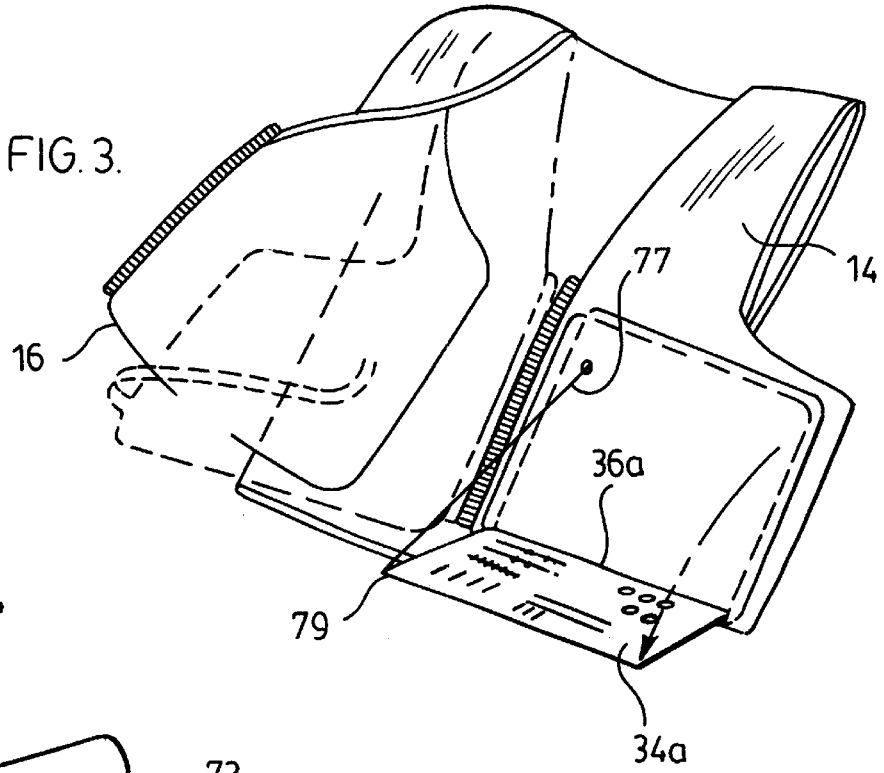
FIG. 3 is a perspective view similar to FIG. 1, showing a second embodiment of this invention.

Especially for use by fly fisherman, a further embodiment of this invention is shown in FIG. 3, in which the pocket member 34*a* is hinged to the front panel 14 along a hinge line 36*a* that extends horizontally, and is located along a horizontal edge of the front panel 14. This allows the pocket member to hinge forwardly and downwardly to the horizontal position shown in FIG. 3, in order to display flies, hooks, sinkers, feathers, etc.

If desired, a strap 77 could be connected between the front panel 14 and a forward corner 79 of the pocket member 34*a,* in order to keep the pocket member horizontal, and its contents easily seen.

Figure 4:
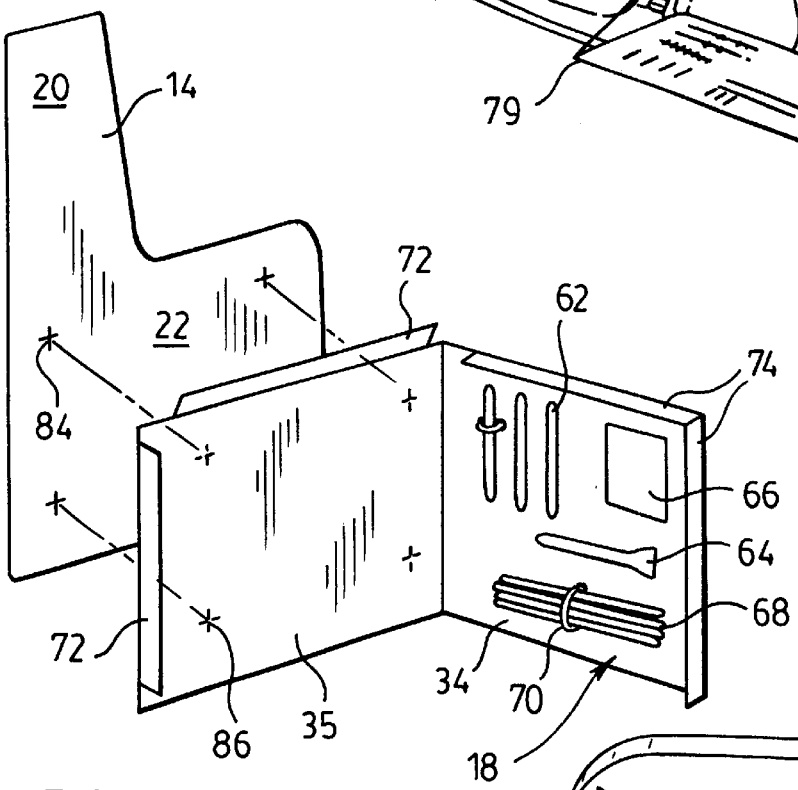
FIG. 4 is an exploded perspective view of a portion of a life jacket and a utility pocket, showing a third embodiment of the present invention.

Referring to FIG. 4, a third embodiment of a life jacket 10 with a pocket 18 is shown. In this embodiment, the pocket member 34 is hingedly coupled to a pocket base member 35. The pocket base member 35 is typically constructed of a rigid material, such as plastic, for example, and covered by two layers of tough, woven material, sewn together at matching edges. The pocket member 34 is coupled to the pocket base member 35 in a similar manner as the pocket member 34 was coupled to the front panel 14, as was described earlier in relation to FIG. 2. Fastener members 86 are located on a rear side of the pocket base member 35.

Mating fastener members 84 are located on the base portion 22 of the front panel 14. The fastener members 84 and 86 are coupled to one another in order to secure the pocket 18 to the front panel 14 of the life jacket 10. The fastener members 84 and 86 typically form a snap-type fastener. This type of fastener allows the pocket 18 to be removed from the life jacket 10 and carried as a separate unit. Alternatively, Velcro™-like fasteners may be used to secure the pocket 18 to the life jacket 10.

Figure 5:
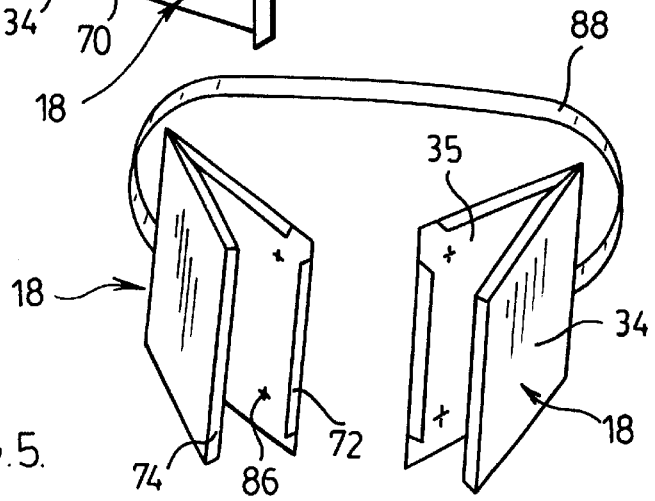
FIG. 5 is a perspective view of a fourth embodiment of the present invention.

Detachable pockets 18, as shown in FIG. 4, may be located on both front panels 14 and 16 of the life jacket 10. A belt 88, as shown in FIG. 5, extends between the pockets so that the pockets 18 can be detached from the life jacket 10 and carried as a unit by a user. The belt 88 may be slung over a user's shoulder so that the pockets 18 may be carried with ease. The life jacket 10 is typically equipped with a belt hook (not shown) that is located on the back panel 12. The belt hook maintains the belt 88 close to the back panel 12 of the life jacket for safety reasons so that the belt 88 is not free to become caught on boating equipment, for example.

The life jacket 10 of any of the four embodiments can additionally be supplied with functional mesh pockets for storing small or flat items. These pockets would typically be equipped with Velcro™-like fasteners to maintain the pockets in a closed position. The mesh pockets may also be located on pockets 18 in order to provide additional storage space.

While four embodiments of this invention have been illustrated in the accompanying drawings and described hereinabove, it will be evident to those skilled in the art that changes and modifications may be made therein without departing from the essence of this invention, as set forth in the appended claims.

What is claimed is:

1. A life jacket comprising:

a back panel defining a first flotation pocket and adapted to lie adjacent a wearer's back;

a front panel defining a second flotation pocket, the front panel being connected with the back panel and adapted to lie adjacent the wearer's front;

at least one pocket member hingedly attached to and supported from said front panel, said at least one pocket member being adapted to contain and retain accessories and including:

a relatively stiff plate member having an inner surface facing toward said front panel when said at least one pocket member is closed, and an outer surface facing away from said front panel when the respective pocket member is closed; and a third flotation pocket adjacent said outer surface of the plate member, the flotation pocket being defined by two layers of a flexible material;

flotation material located in the first, second and third flotation pockets; and at least one fastener for releasably retaining said at least one pocket member in juxtaposition against the front panel, thereby defining at least one pocket between said at least one pocket member and the front panel.

2. The life jacket claimed in claim 1 wherein the pocket member further includes a relatively resilient cushion layer substantially covering said inner surface of the plate member.

3. The life jacket claimed in claim 1, in which the flotation material consists of plastic material having internal closed voids.

4. The life jacket claimed in claim 1, in which there are two front panels, at least one of said front panels supporting a pocket member.

5. The life jacket of claim 4 wherein each of said front panels supports a pocket member.

6. The life jacket claimed in claim 1, in which said at least one pocket member adjoins said front panel along a hinge line which extends substantially vertically when the life jacket is in its position of use.

7. The life jacket claimed in claim 1, in which said at least one pocket member adjoins said front panel along a hinge line which extends substantially horizontally when the life jacket is in its position of use.

8. The life jacket claimed in claim 1, wherein said flotation material in the third pocket is sufficiently buoyant to counteract any extra downward gravitational pull due to the density of any emergency accessories stored in the region between the pocket member and the front panel, whereby the wearer of the life jacket tends to float with his head back rather than with his head forward.

9. The life jacket claimed in claim 5, in which the flotation material consists of plastic material having internal closed voids; and in which each pocket member adjoins its respective front panel along a hinge line which extends substantially horizontally when the life jacket is in its position of use.

10. The life jacket claimed in claim 5, in which the flotation material consists of plastic material having internal closed voids; and in which each pocket member adjoins its respective front panel along a hinge line which extends substantially vertically when the life jacket is in its position of use.

11. The life jacket claimed in claim 2, further comprising a plurality of elasticated loops extending, at spaced-apart locations, through the plate member and the cushion layer, thereby providing retaining means for gripping the said emergency accessories and holding them securely against the cushion layer.

12. A utility pocket for a life jacket, said utility pocket comprising:

at least one pocket member hingedly attached to and supported from a pocket base member, the pocket base member being coupled to a front panel of said life jacket, said pocket member including:

a relatively stiff plate member having an inner surface facing toward said front panel when said at least one pocket member is closed, and an outer surface facing away from said front panel when said at least one pocket member is closed;

a flotation pocket adjacent said outer surface of the plate member, the flotation pocket being defined by two layers of a flexible material and flotation material being located in said flotation pocket; and wherein said pocket base member is detachable from said front panel of said life jacket.

13. The utility pocket claimed in claim 12 wherein the pocket member further includes a relatively resilient cushion layer substantially covering said inner surface of the plate member.

14. The utility pocket claimed in claim 12, in which the flotation material consists of plastic material having internal closed voids.

15. The utility pocket claimed in claim 12 further comprising a second utility pocket coupled to the first utility pocket by a belt.

* * * * *